US008025373B2

(12) United States Patent
Sugahara

(10) Patent No.: US 8,025,373 B2
(45) Date of Patent: Sep. 27, 2011

(54) PRINTER SYSTEM, MAIN PRINTER AND SUB PRINTER TO BE USED THEREFOR, AND INK SUPPLY METHOD

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 651 days.

(21) Appl. No.: 12/050,884

(22) Filed: Mar. 18, 2008

(65) Prior Publication Data

US 2008/0231674 A1 Sep. 25, 2008

(30) Foreign Application Priority Data

Mar. 19, 2007 (JP) ..... 2007-071166

(51) Int. Cl.
*B41J 2/175* (2006.01)

(52) U.S. Cl. ..... 347/85; 347/84; 347/86

(58) Field of Classification Search ..... 347/84, 347/85, 86, 5, 9, 19
See application file for complete search history.

(56) References Cited

U.S. PATENT DOCUMENTS 6,200,043 B1 3/2001 Inoue et al.
6,769,766 B2 * 8/2004 Suzuki et al. ..... 347/100
2002/0089577 A1 * 7/2002 Dietl et al. ..... 347/87
2005/0062815 A1 * 3/2005 Yoshihira et al. ..... 347/89
2008/0231677 A1 * 9/2008 Sugahara ..... 347/89

FOREIGN PATENT DOCUMENTS

EP 0798122 A2 10/1997
JP H09-058060 A 3/1997
JP H09-300718 A 11/1997
JP H09-300782 A 11/1997
JP H11-301057 A 11/1999
JP 2002-361934 A 12/2002

OTHER PUBLICATIONS

European Patent Office; European Search Report in Application No. 08004784.1-1251/1972452 mailed Apr. 2, 2009.

* cited by examiner

*Primary Examiner* — Manish S Shah
(74) *Attorney, Agent, or Firm* — Baker Botts L.L.P.

(57) ABSTRACT

A printer system includes a main printer which has a first tank and a first head, a sub printer which has a second tank having a volume smaller than the first tank and a second head and which is provided detachably with respect to the main printer, and a supply mechanism which supplies the ink from the first tank to the second tank when the sub printer is installed to the main printer. Accordingly, it is possible to provide the printer system, which is not provided with any exclusive station that finds no way of use except for the ink supplement and requires any excessive installation space, while the sub printer is of the ink supplement type.

17 Claims, 15 Drawing Sheets

PRINTER SYSTEM, MAIN PRINTER AND SUB PRINTER TO BE USED THEREFOR, AND INK SUPPLY METHOD

CROSS REFERENCE TO RELATED APPLICATION

The present application claims priority from Japanese Patent Application No. 2007-071166, filed on Mar. 19, 2007, the disclosure of which is incorporated herein by reference in its entirety.

BACKGROUND OF THE INVENTION

1. Field of the Invention

The present invention relates to a main printer which has a first tank and a first head, a sub printer which has a second tank having a volume smaller than that of the first tank and a second head, a printer system which is composed of the main printer and the sub printer, and an ink supply method for supplying the ink from the first tank and the second tank.

2. Description of the Related Art

A portable type printer has been suggested, which is small in size as compared with a stationary type printer provided with a paper feed/discharge mechanism and which can be carried about, for example, with one hand (see, for example, Japanese Patent Application Laid-open No. 2002-361934). The portable type printer has a small casing. Therefore, the portable type printer cannot carry any large volume ink tank as the ink tank for storing the discharge ink to be discharged to a recording member or medium. In view of the above, in order to supplement with the ink when the residual amount is in shortage while carrying an ink tank having a small volume, an exclusive station is prepared, to which the portable type printer is subjected to the docking. In the case of an exclusive station disclosed in Japanese Patent Application Laid-open No. 2002-361934, when the portable type printer is subjected to the docking, the ink tank of the portable type printer is supplemented with the ink from the exclusive station.

However, the exclusive station as described above finds no way of use except when the portable printer is supplemented with the ink. Further, the installation space is not small as well. In this viewpoint, it is not affirmed that the exclusive station as described above is convenient for the user. On the other hand, if the ink tank of the portable type printer itself is exchangeable, then the volume of the ink tank is small, and hence it is necessary that the exchange operation should be performed frequently, which is not preferred.

SUMMARY OF THE INVENTION

In view of the above, an object of the present invention is to provide a printer system for which it is unnecessary to provide any exclusive station that finds no way of use except for the ink supplement and requires any excessive installation space, while a portable type printer is of the ink supplement type, provide a main printer and a sub printer to be used for such a printer system, and provide an ink supply method.

According to a first aspect of the present invention, there is provided a printer system which performs printing by discharging an ink onto a recording medium, the printer system including:

a main printer including a first tank which stores the ink and a first head which discharges the ink supplied from the first tank onto the recording medium;

a portable type sub printer which is detachably accommodated with the main printer, the sub printer including a second ink tank which stores the ink, the second ink tank of which volume is smaller than that of the first tank, and a second head which discharges the ink supplied from the second tank onto the recording medium; and a supply mechanism which connects the first tank and the second tank to supply the ink from the first tank to the second tank when the sub printer is installed to the main printer.

According to the first aspect of the present invention, the ink can be supplied from the first tank of the main printer to the second tank of the sub printer by installing the sub printer to the main printer, the second tank having the volume smaller than that of the first tank. The main printer, which has the first head, is provided with the first tank having the large volume. Therefore, the main printer can be used as an ordinary printer except when the sub printer is supplemented with the ink. Further, the main printer as described above is equivalent to the stationary type printer which is widely used in homes, and the main printer is replaceable with the stationary type printer. Therefore, when the main printer is installed in the space in which the stationary type printer is originally installed, it is unnecessary to provide any excessive installation space, which is convenient.

In the printer system of the present invention, the supply mechanism may include a first regulating section which regulates a flow of the ink between the first tank and the first head, and the regulating mechanism may regulate to stop the flow of the ink between the first tank and the first head when the ink is supplied from the first tank to the second tank. In this case, it is possible to avoid the leakage of the ink from the nozzle holes of the first head by the pressure of the supplied ink, and it is possible to avoid the destruction of the meniscus formed in the nozzle hole, when the ink is supplied from the first tank to the second tank.

In the printer system of the present invention, the supply mechanism may include a first supply mechanism which is provided in the main printer and a second supply mechanism which is provided in the sub printer; the first supply mechanism may include a first regulating section which regulates flow of the ink between the first tank and the first head, a first connecting section which is communicated with the first tank and which is connected the sub printer, and a second regulating section which regulates flow of the ink between the first tank and the first connecting section; the second supply mechanism may include a second connecting section which is connected to the first connecting section to make communication between the first tank and the second tank when the second supply mechanism is communicated with the second tank and installed to the main printer; and the first regulating section and the second regulating section may be operable independently from each other. In this arrangement, the first regulating section and the second regulating section can be appropriately operated in accordance with the ink supplying operation for supplying the ink to the second tank possessed by the sub printer and the ink discharge operation for discharging the ink from the first head. For example, when the ink is supplied to the second tank, it is appropriate that the flow of the ink is regulated by the first regulating section between the first tank and the first head. When the ink is discharged from the first head, it is appropriate that the flow of the ink is regulated between the first tank and the second tank by means of the second regulating section even when the sub printer is installed to the main printer.

In the printer system of the present invention, the supply mechanism may supply the ink from the first tank to the second tank when the first connecting section and the second connecting section are connected to one another. In this case, the ink supply can be started to supply the ink to the second tank of the sub printer by using the trigger of the installation of the sub printer to the main printer and the connection of the first connecting section and the second connecting section without performing any other operation.

In the printer system of the present invention, the supply mechanism may supply the ink from the first tank to the second tank when the first connecting section and the second connecting section are connected to one another and a residual amount of the ink contained in the second tank of the sub printer may not be more than a predetermined value. In this arrangement, the supply of the ink to the second tank can be executed when the residual amount of the second tank is decreased and the ink supply is required.

In the printer system of the present invention, the printer system may further include an input device which inputs a predetermined instruction, wherein the supply mechanism supplies the ink from the first tank to the second tank when the first connecting section and the second connecting section are connected to one another and an instruction to execute ink supply to the second tank of the sub printer is inputted via the input device. In this arrangement, the ink can be supplied to the second tank in accordance with the timing determined by the user.

In the printer system of the present invention, the supply mechanism may include a pump which supplies the ink contained in the first tank to the first head and which supplies the ink from the first tank to the second tank. In this arrangement, the pump (for example, the pump for the purge), which supplies the ink from the first tank to the first head, can be also used as the pump which supplies the ink from the first tank to the second tank. When any pump, which is to be used to supply the ink to the second tank, is not carried on the sub printer as described above, the space in the casing of the sub printer can be used to realize the large volume or capacity of the second tank.

In the printer system of the present invention, the main printer may include a casing in which the first head is accommodated, a first installing section in which the first tank is accommodated detachably, and a second installing section to which the sub printer is installed detachably, and the first installing section and the second installing section may be arranged adjacently on an identical wall surface of the casing. When the printer system is constructed as described above, the attachment/detachment of the first tank with respect to the main printer and the attachment/detachment of the sub printer can be performed on the identical wall surface. Therefore, no inconvenience arises in relation to the direction in which the main printer is installed, which is convenient for the user.

In the printer system of the present invention, the supply mechanism may include a detecting mechanism which detects an installation of the sub printer to the second installing section, and an ink amount-detecting mechanism which detects an ink amount contained in the second tank of the sub printer. In this arrangement, the supply mechanism of the printer system has the detecting mechanism for detecting the installation of the sub printer and the ink amount-detecting mechanism for detecting the ink amount contained in the second tank of the sub printer. Therefore, the information obtained therefrom can be utilized as the trigger information for the operation to supply the ink from the first tank to the second tank.

According to a second aspect of the present invention, there is provided a main printer which performs printing by discharging an ink onto a recording medium, the main printer including:

a first tank which stores an ink;

a first head which discharges the ink supplied from the first tank onto a recording medium;

an installing section which accommodates detachably a portable type sub printer including a second tank which stores the ink and which has a volume smaller than that of the first tank, and a second head which discharges the ink supplied from the second tank onto the recording medium; and a supply mechanism which connects the second tank and the first tank to supply the ink from the first tank to the second tank when the sub printer is installed to the installing section.

According to the second aspect of the present invention, the main printer can be used as the ordinary printer except when the ink is supplied to the sub printer. Further, it is unnecessary to provide any excessive installation space as well.

In the main printer of the present invention, the supply mechanism may further include a first regulating section which regulates a supply of the ink from the first tank to the first head, a connecting section which connects the first tank and the second tank in a communicated state, and a second regulating section which regulates a supply of the ink from the first tank to the connecting section. In this arrangement, the first regulating section and the second regulating section can be appropriately operated in accordance with the ink supply operation for supplying the ink to the second tank possessed by the sub printer and the ink discharge operation for discharging the ink from the first head.

According to a third aspect of the present invention, there is provided a portable type sub printer which performs printing by discharging an ink onto a recording medium, the sub printer including:

a second tank which stores the ink; and a second head which discharges the ink supplied from the second tank, wherein the sub printer is detachably installed to a main printer including the first tank which stores the ink and a first head which discharges the ink supplied from the first tank onto the recording medium, the second tank has a volume smaller than that of the first tank, and the second tank is communicated with the first tank when the sub printer is installed to the main printer.

According to the third aspect of the present invention, even when the sub printer carries the second tank having the small volume, the ink can be supplied from the first tank of the main printer.

The sub printer may further include a connecting section which connects the first tank and the second tank in a communicated state.

The sub printer of the present invention may further include a roller which maintains a constant distance between the second head and the recording medium, a position-detecting section which detects a position of the sub printer based on an angle of rotation of the roller, and a control mechanism which is connected to the position-detecting section and which controls discharge of the ink from the second head. In this arrangement, the control mechanism can control the discharge of the ink from the second head on the basis of the information in relation to the position of the sub printer detected by the position-detecting section.

According to a fourth aspect of the present invention, there is provided a method for supplying an ink for a printer system, the printer system including:

a main printer including a first tank which stores the ink and a first head which discharges the ink supplied from the first tank onto the recording medium;

a portable type sub printer accommodated detachably with the main printer, the sub printer including a second tank which stores the ink, the second tank having a volume smaller than that of the first tank, and a second head which discharges the ink supplied from the second tank onto a recording medium; and an ink supply mechanism including a first valve which regulates a flow of the ink between the first tank and the first head, a second valve which regulates a flow of the ink between the first tank and the second tank, and a pump which supplies the ink from the first tank to the second tank, and the method including:

detecting an installation of the sub printer to the main printer;

closing the first valve and opening the second valve when the installation of the sub printer is detected; and driving the pump to supply the ink from the first tank to the second tank.

According to the fourth aspect of the present invention, the ink can be easily supplied from the ink tank having the large volume of the main printer and the ink tank having the small volume of the sub printer.

The method for supplying the ink according to the present invention may further include detecting an amount of the ink contained in the second tank, and the first valve may be closed and the second valve may be opened when the installation of the sub printer is detected and the amount of the ink contained in the second tank is not more than a predetermined amount.

In the method for supplying the ink of the present invention, the printer system may further include an input device which inputs a predetermined instruction, and the method may further include closing the first valve and opening the second valve when the installation of the sub printer is detected and an instruction to execute ink supply to the second tank is inputted via the input device.

According to the printer system, the main printer, and the sub printer concerning the present invention, any exclusive station, which requires any excessive installation space and which finds no way of use except for the ink supplement, is not required to be provided, while the portable type printer is of the ink supplement type.

DESCRIPTION OF THE PREFERRED EMBODIMENTS

An explanation will be specifically made below with reference to the drawings about a printer system according to an embodiment of the present invention and a main printer and a sub printer which constitute the same.

Figure 1:
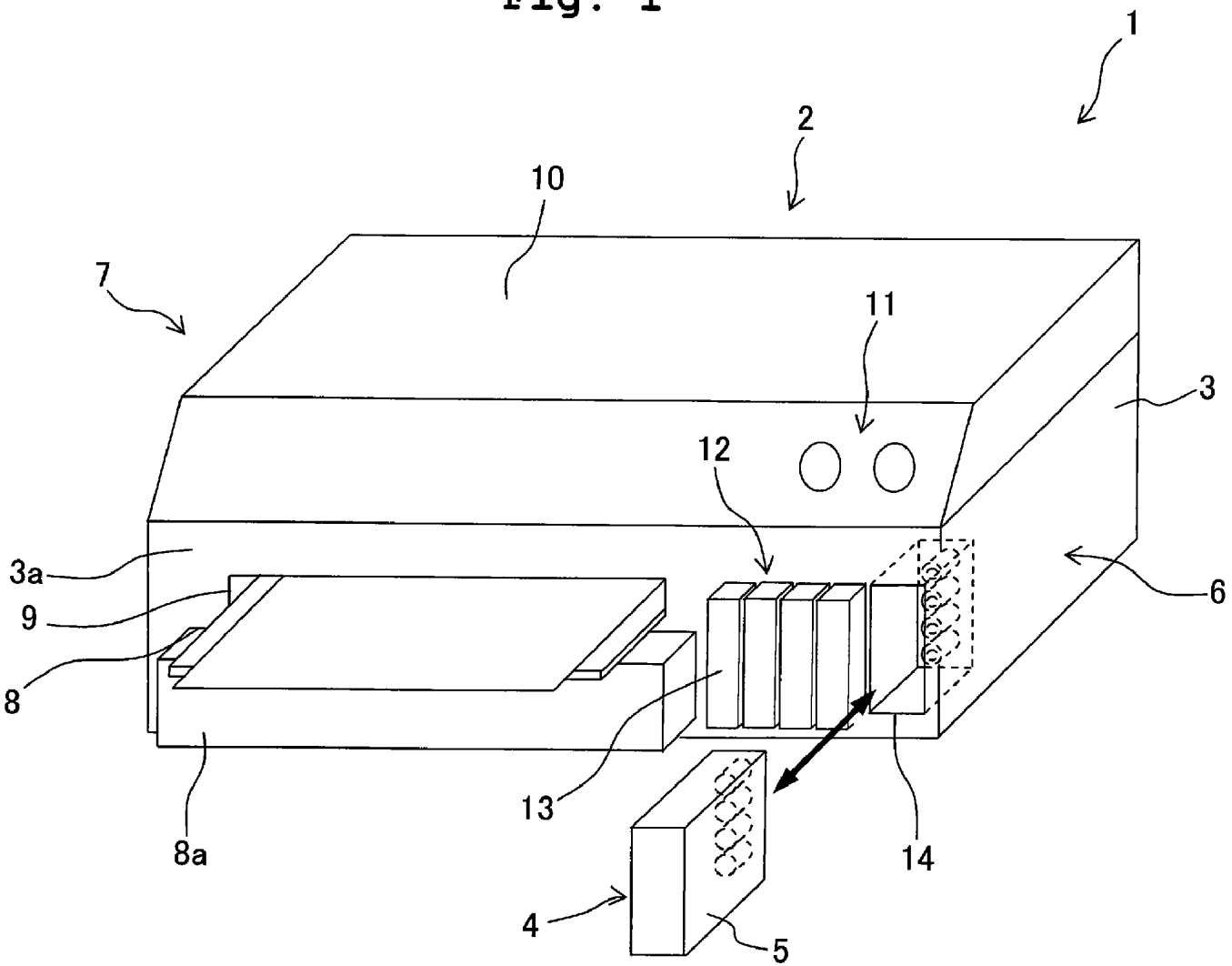
FIG. 1 schematically shows a perspective view illustrating a structural appearance of a printer system according to an embodiment of the present invention.

FIG. 1 schematically shows a perspective view illustrating a structural appearance of a printer system 1 according to an embodiment of the present invention. As shown in FIG. 1, the printer system 1 comprises a main printer (master printer or server printer) 2 of the stationary type which has a substantially rectangular parallelepiped-shaped casing 3, and a portable type sub printer (slave printer or client printer) 4 which is detachably installed to the main printer 2 and which has a casing 5 that is relatively smaller than the casing 3.

In this embodiment, the main printer 2 is a multifunction machine. The main printer 2 has a printer section 6 which is provided at a lower portion of the casing 3 and which has a first head 41 (see FIG. 4) for recording the image by means of the ink-jet system. The main printer 2 has a scanner section 7 which is provided at an upper portion of the casing 3 and which has an image sensor (not shown) to read the image of a manuscript. A paper feed port 8 is formed at a lower portion of a front wall 3*a* of the casing 3. A paper feed tray 8*a*, which accommodates the recording paper (recording member or recording medium), is installed thereto. In this arrangement, a plurality of sheets of the recording paper, which have the A4 size at the maximum, can be accommodated in the paper feed tray 8*a*.

A paper discharge port 9 is formed over the paper feed port 8 of the front wall 3*a*. The recording paper, on which the image is formed by the printer section 6, is discharged from the paper discharge port 9. The scanner section 7 is a so-called flat bed scanner. The scanner section 7 has a manuscript stand (not shown) which is formed on the upper surface of the casing 3, and a manuscript cover 10 which is provided openably/closably to cover the manuscript stand. An operation panel 11, which is used to operate the printer section 6 and the scanner section 7, is provided in front of the manuscript cover 10.

A tank-installing section 12, to which first ink tanks (ink cartridges) 13 are detachably installed, is provided on the front wall 3*a* of the casing 3 at a side portion with respect to the paper feed port 8 and the paper discharge port 9. The first ink tank 13 has a large volume or capacity (for example, 10 cc), which stores the ink to be discharged to the recording paper when the image is formed by the printer section 6.

When the residual amount of the ink in the first ink tank 13 is not more than a predetermined value as the ink is discharged onto the recording paper, then the first ink tank 13 is detached from the tank-installing section 12, and a new first ink tank 13, which is fully filled with the ink, can be installed. In this embodiment, those used as the inks employed to form the image include four color inks, i.e., cyan (C), magenta (M), and yellow (Y) as the dye inks and black (Bk) as the pigment ink. Therefore, the four first ink tanks 13 in total, which correspond to the respective colors, are detachably installed to the tank-installing section 12.

A sub printer-installing port 14, to which the sub printer 4 is installed, is provided on the front wall 3*a* of the casing 3 at a side portion with respect to the tank-installing section 12. As described above, both of the tank-installing section 12 and the sub printer-installing port 14 are provided on the identical wall surface (front wall 3*a*) of the casing 3. Therefore, the degree of freedom is increased for the installation of the main printer 2 as compared with a case in which the both are provided on distinct wall surfaces, which is convenient for the user.

Figure 2:
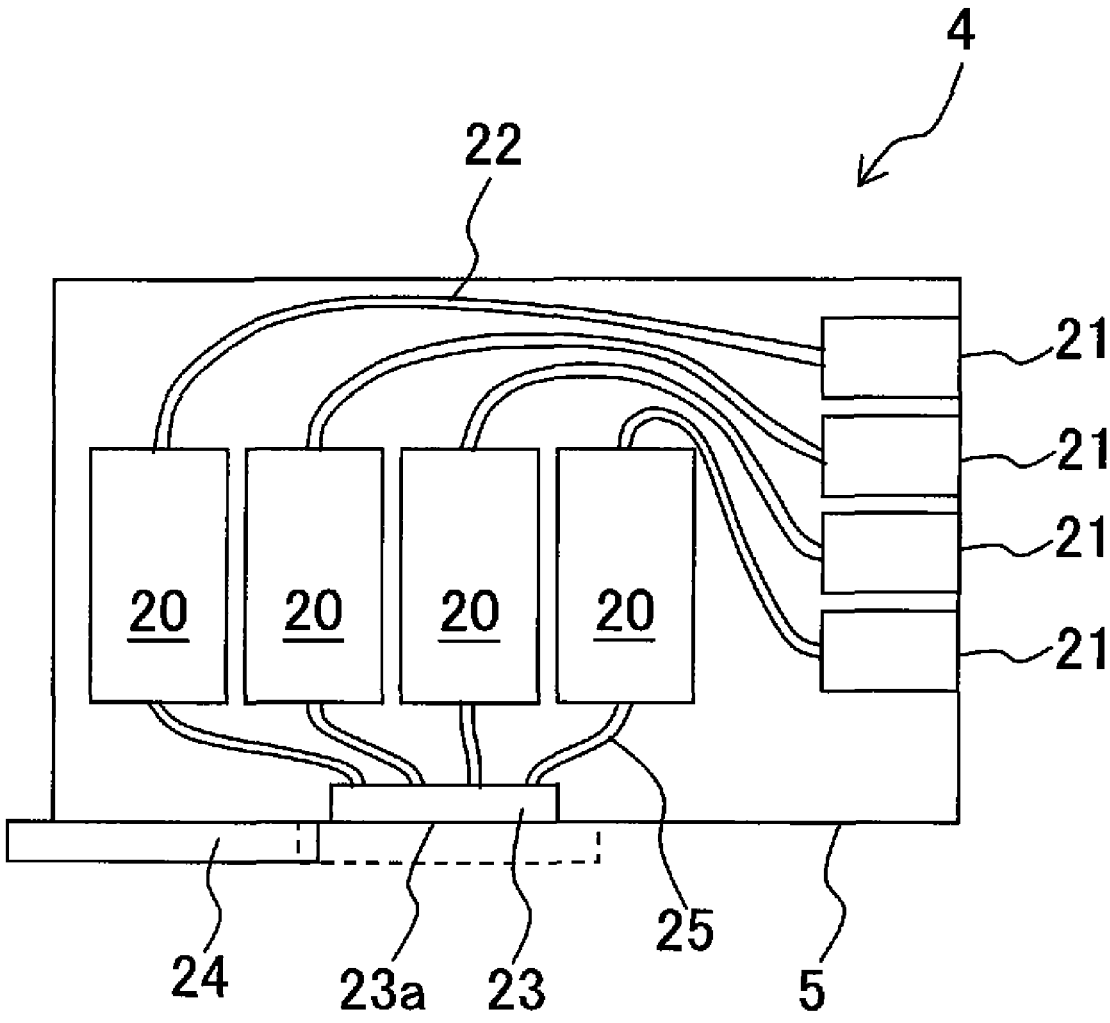
FIG. 2 schematically shows a side view illustrating an internal arrangement of a sub printer.
Figure 3:
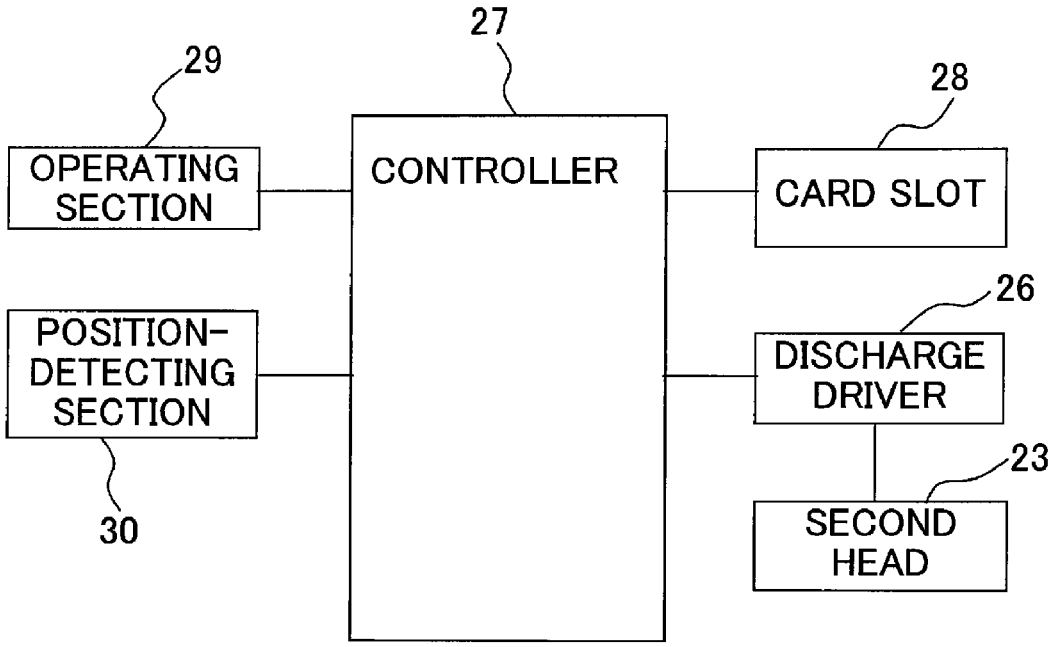
FIG. 3 shows a block diagram illustrating the function of the sub printer shown in FIG. 2.

FIG. 2 schematically shows a side view illustrating an arrangement of the sub printer 4, which depicts an internal structure as viewed when one side surface of the casing 5 is removed. FIG. 3 shows a block diagram illustrating the function of the sub printer 4 shown in FIG. 2. As shown in FIG. 2, the sub printer 4 has the rectangular parallelepiped-shaped casing 5 and four second ink tanks 20 each having a small volume (for example, 1 cc) provided in the casing 5. The second ink tanks 20 correspond to the four color inks described above. Four subsidiary-side connecting sections 21, which make communication between the second ink tanks 20 and the first ink tanks 12 installed to the main printer 2, are provided on one side wall of the casing 5. The subsidiary-side connecting sections 21 correspond to the four second ink tanks 20. The subsidiary-side connecting sections 21 are connected to the second ink tanks 20 one to one via tubes 22.

A second head 23 (see FIG. 3) having a nozzle surface 23*a* and a head cover 24 to openably/closably cover the nozzle surface 23*a* of the second head 23 are provided on another side wall of the casing 5. The nozzle surface 23*a* is provided so that the nozzle surface 23*a* is exposed to the outside of the second head 23. When the head cover 24 is closed (as shown by broken lines in FIG. 2), the nozzle surface 23*a* is covered with the head cover 24 substantially hermetically. When the head cover 24 is opened (as shown by solid lines in FIG. 2), the nozzle surface 23*a* is exposed to the outside of the second head 23. The second ink tanks 20 of the respective colors are connected to the second head 23 via tubes 25. The inks, which are supplied from the second ink tanks 20, are discharged to the outside.

As shown in FIG. 3, the sub printer 4 includes a discharge driver 26 for driving the second head 23. The discharge driver 26 is connected to a controller 27. The controller 27 is composed of, for example, an IC chip, RAM, and ROM, which is operable in accordance with a program recorded in ROM. The sub printer 4 is provided with a card slot 28 which is connected to the controller 27, an operating section 29, and a position-detecting section 30. Various types of small-sized memory cards as storage media can be installed to the card slot 28. For example, the image data, which is stored in the small-sized memory card installed to the card slot 28, can be read by performing the predetermined operation with the operating section 29. The read image data is once stored in RAM possessed by the controller 27. The second head 23 discharges the inks in accordance with the instruction supplied from the controller 27, and thus the image represented by the image data can be formed on the recording medium.

The sub printer 4 is provided with a roller or rollers (not shown) for maintaining a constant distance from the recording paper, for example, when the manual scanning is performed on the recording paper. The position-detecting section 30 is capable of detecting the position of the sub printer 4 in accordance with the angle of rotation of the roller. The controller 27 controls the ink discharge from the second head 23 on the basis of the information in relation to the position inputted from the position-detecting section 30.

The sub printer 4 can receive the ink supplied to the second ink tank 20 of the sub printer 4 from the first tank 12 installed to the main printer 2 when the sub printer 4 is installed to the main printer 2. An explanation will be made below in respective embodiments about forms of connection brought about when the sub printer 4 is installed to the main printer 2.

First Embodiment

Figure 4:
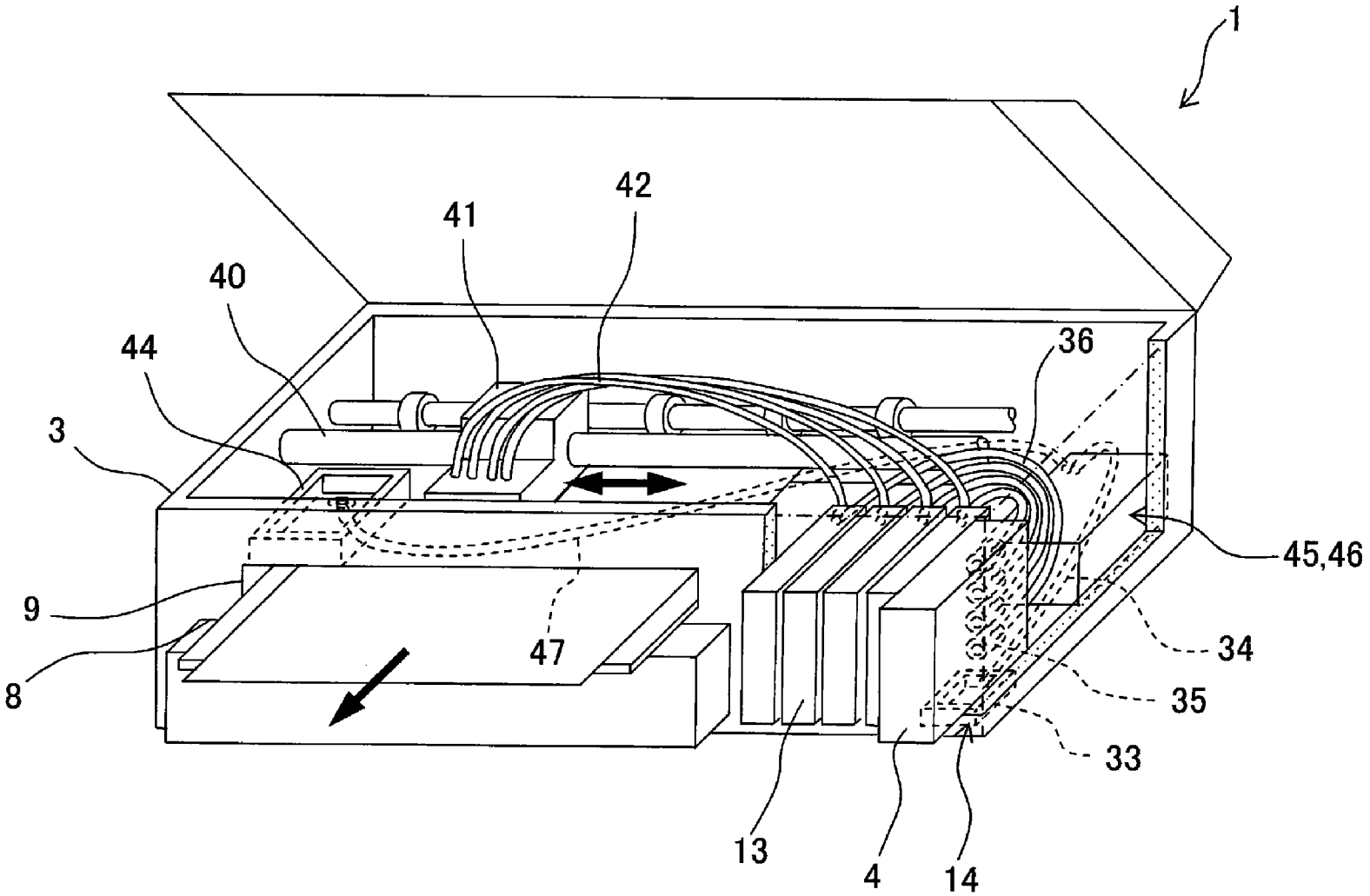
FIG. 4 schematically shows a perspective view illustrating an internal arrangement of a main printer to which the sub printer is installed.
Figure 5:
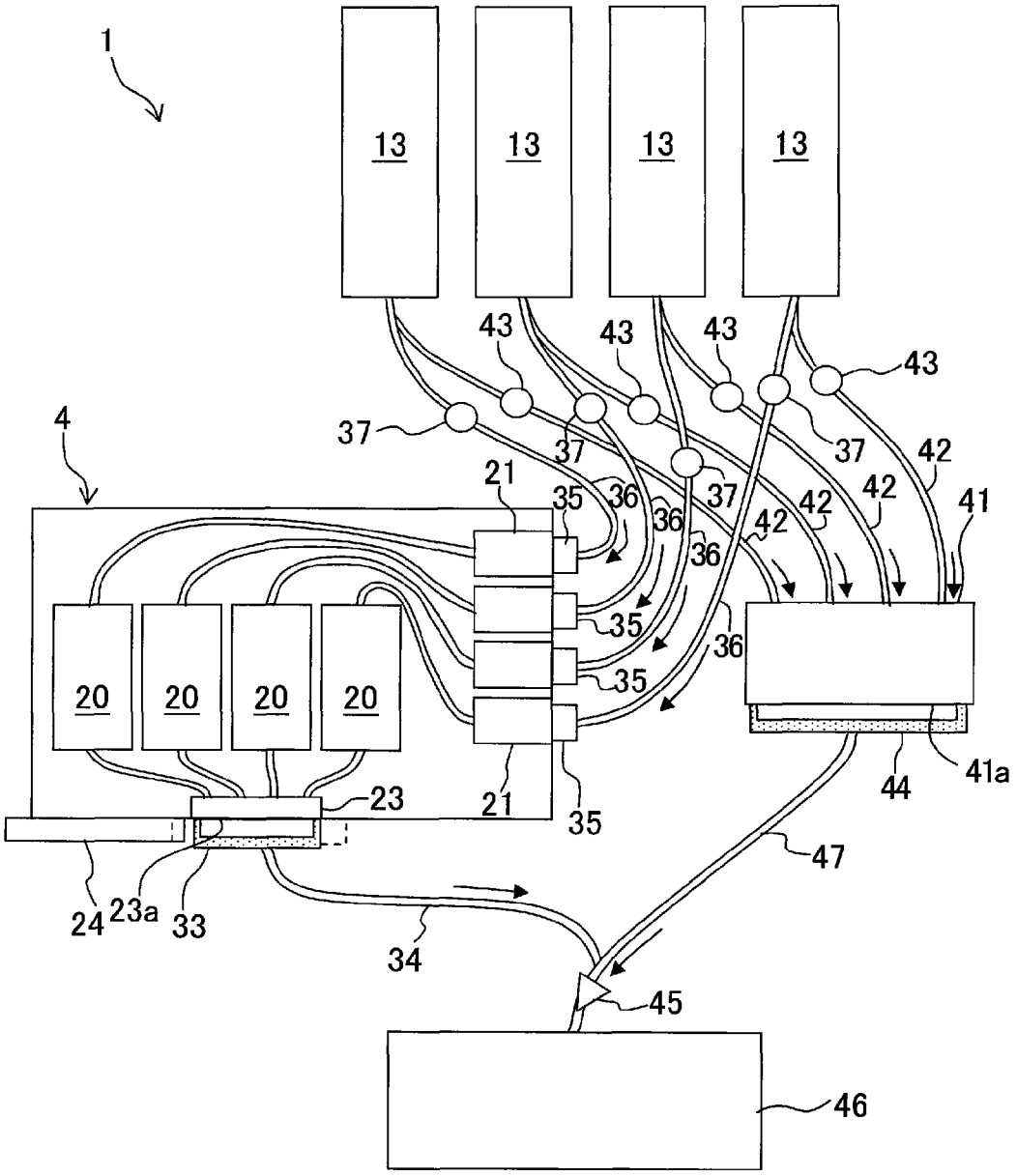
FIG. 5 schematically shows a printer system according to a first embodiment.

FIG. 4 schematically shows a perspective view illustrating an internal arrangement of the main printer 2 to which the sub printer 4 as described above is installed. FIG. 5 schematically shows the printer system 1, which depicts a form of connection according to a first embodiment when the sub printer 4 is installed to the main printer 2.

As shown in FIG. 4, a guide rod 40, which extends in the left-right direction, is provided in the casing 3 of the main printer 2. A first head 41 (see FIG. 5) is supported by the guide rod 40 so that the first head 41 is capable of being subjected to the scanning in the left-right direction. Four tubes 42, which correspond to the respective colors of the inks, are provided to extend from the first head 41. The tubes 42 are connected to the tank-installing section 12 respectively. As shown in FIG. 5, first valves (first regulating sections) 43, which regulate the flow of the inks, are provided for the tubes 42 respectively. The respective first valves 43 are operable independently from each other.

Therefore, when the first ink tanks 13 are installed to the tank-installing section 12, the first ink tanks 13 and the first head 41 are communicated with each other via the tubes 42 in a state in which the first valves 43 are opened. Therefore, the inks of the respective colors can be independently supplied from the first ink tanks 13 to the first head 41. On the other hand, the inks are not allowed to flow via the tubes 42 between the first ink tanks 13 and the first head 41 in a state in which the first valves 43 are closed, because the closing is effected between the first ink tanks 13 and the first head 41.

As shown in FIG. 4, a first cap (cap for the first head) 44, which hermetically seals the nozzle surface 41*a* of the first head 41 (see FIG. 5) from the lower portion, is provided in the casing 3 of the main printer 2. The first cap 44 is provided at the position at which the first cap 44 is opposed to the nozzle surface (ink discharge surface) 41*a* when the first head 41 is positioned at one end in the scanning range. In FIG. 4, the first cap 44 is provided opposingly to the left end of the scanning range of the first head 41. A pump 45 and a waste ink-accommodating section 46 are provided at the back of the tank-installing section 12 at the right end in the casing 3. The waste ink-accommodating section 46 has an unillustrated case and an ink-absorbing member such as sponge accommodated in the case. As shown in FIG. 5, the waste ink-accommodating section 46 is communicated with the first cap 44 via a tube (communication passage) 47. The pump 45 is capable of sucking the fluid via the tube 47.

As shown in FIG. 4, a second cap 33 is arranged in the vicinity of the lower portion of the sub printer-installing port 14 in the casing 3. The second cap 33 hermetically seals the nozzle surface (ink discharge surface) 23*a* of the second head 23 of the sub printer 4 from the lower position when the sub printer 4 is installed to the sub printer-installing port 14. As shown in FIG. 5 as well, the second cap 33 is connected to the waste ink-accommodating section 46 via a tube (communication passage) 34. The fluid, which is contained in the tube 34, is also sucked by the pump 45 described above.

Main-side connecting sections 35 are provided in the sub printer-installing port 14 in the main printer 2. When the sub printer 4 is installed to the sub printer-installing port 14, the main-side connecting sections 35 are connected to the subsidiary-side connecting sections 21 (see FIG. 5). Tubes 36 are allowed to extend from the main-side connecting sections 35. Forward ends of the tubes 36 are connected to the first ink tanks 13 installed to the tank-installing section 12. Second valves (second regulating sections) 37, which regulate the flow of the inks in the tubes 36, are provided at intermediate positions of the tubes 36 which are allowed to extend from the main-side connecting sections 35 to the first ink tanks 13. The respective second valves 37 are operable independently from each other.

Figure 6:
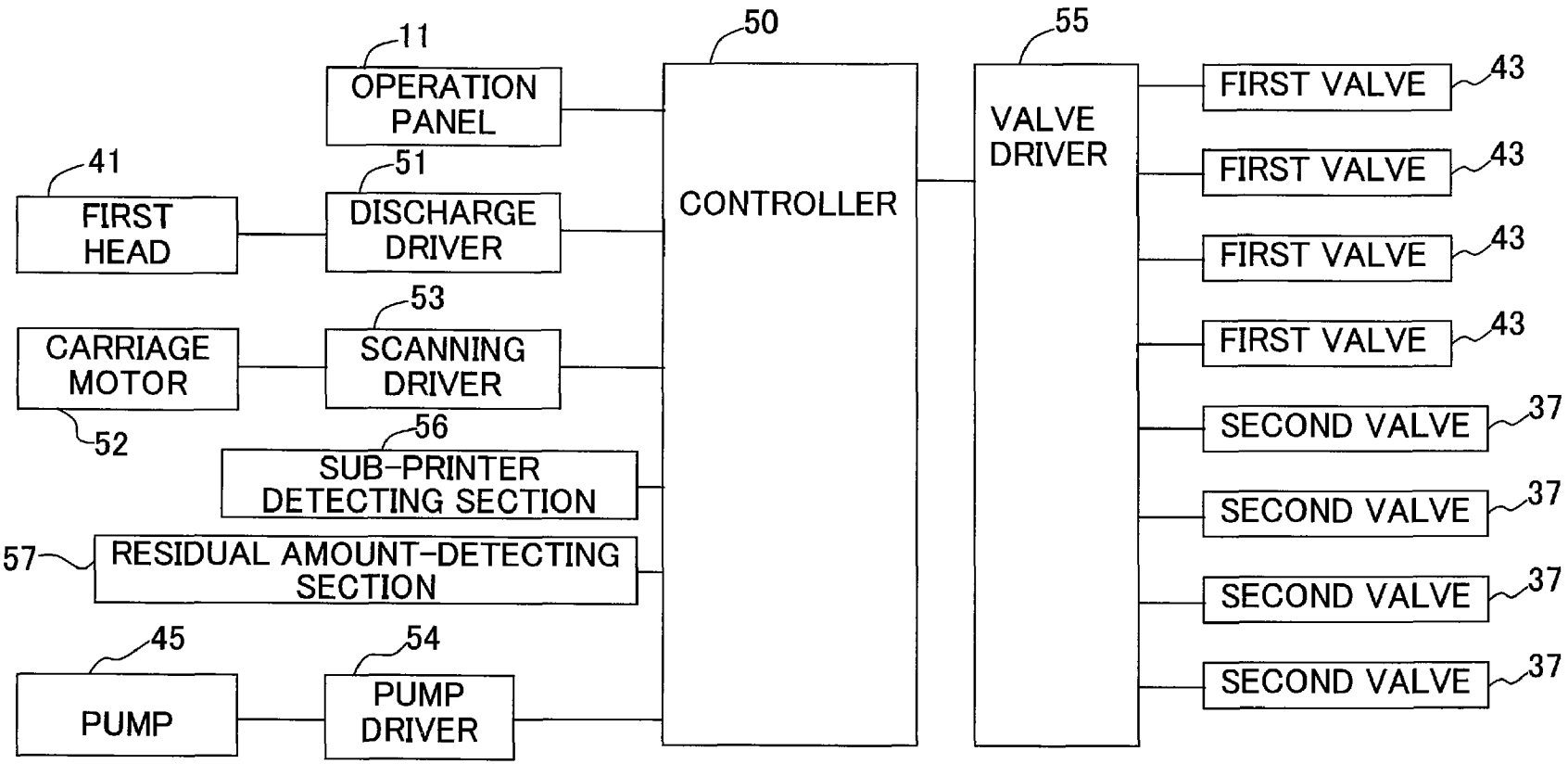
FIG. 6 shows a block diagram illustrating the function of the main printer.

FIG. 6 shows a block diagram illustrating the function of the main printer 2 described above. As shown in FIG. 6, the main printer 2 is provided with a controller 50. The operation panel 11 is connected to the controller 50. Further, the first head 41 is connected to the controller 50 via a discharge driver 51. The main printer 2 further comprises a carriage motor 52 which moves the first head 41 in the scanning direction, and a scanning driver 53 which drives the carriage motor 52. The carriage motor 52 is connected to the controller 50 via the scanning driver 53. Therefore, when the user operates the operation panel 11, the controller 50 outputs control signals to the discharge driver 51 and the scanning driver 53 respectively. The scanning driver 53 moves the first head 41 by a predetermined distance in the scanning direction on the basis of the control signal. The discharge driver 51 allows the head 41 to discharge the inks on the basis of the control signal.

The pump 45 described above is connected to the controller 50 via a pump driver 54. Further, the valves 37, 43 are connected to the controller 50 via a valve driver 55. The pump driver 54 and the valve driver 55 output driving signals on the basis of control signals supplied from the controller 50 to drive the pump 45 and the valves 37, 43 in accordance with the driving signals.

Further, a sub printer-detecting section 56 and a residual amount-detecting section 57 are connected to the controller 50. The sub printer-detecting section 56 detects whether or not the sub printer 4 is connected to the main printer 2, in particular whether or not the sub printer 4 is installed to the sub printer-installing port 14 to connect the sub printer side connecting sections 21 with respect to the main printer side connecting sections 35. The information thereof is outputted to the controller 50. The residual amount-detecting section 57 detects the ink residual amount in the second ink tank 20 of each of the colors possessed by the sub printer 4 when the sub printer 4 is installed to the main printer 2. The information thereof is outputted to the controller 50.

Figure 7:
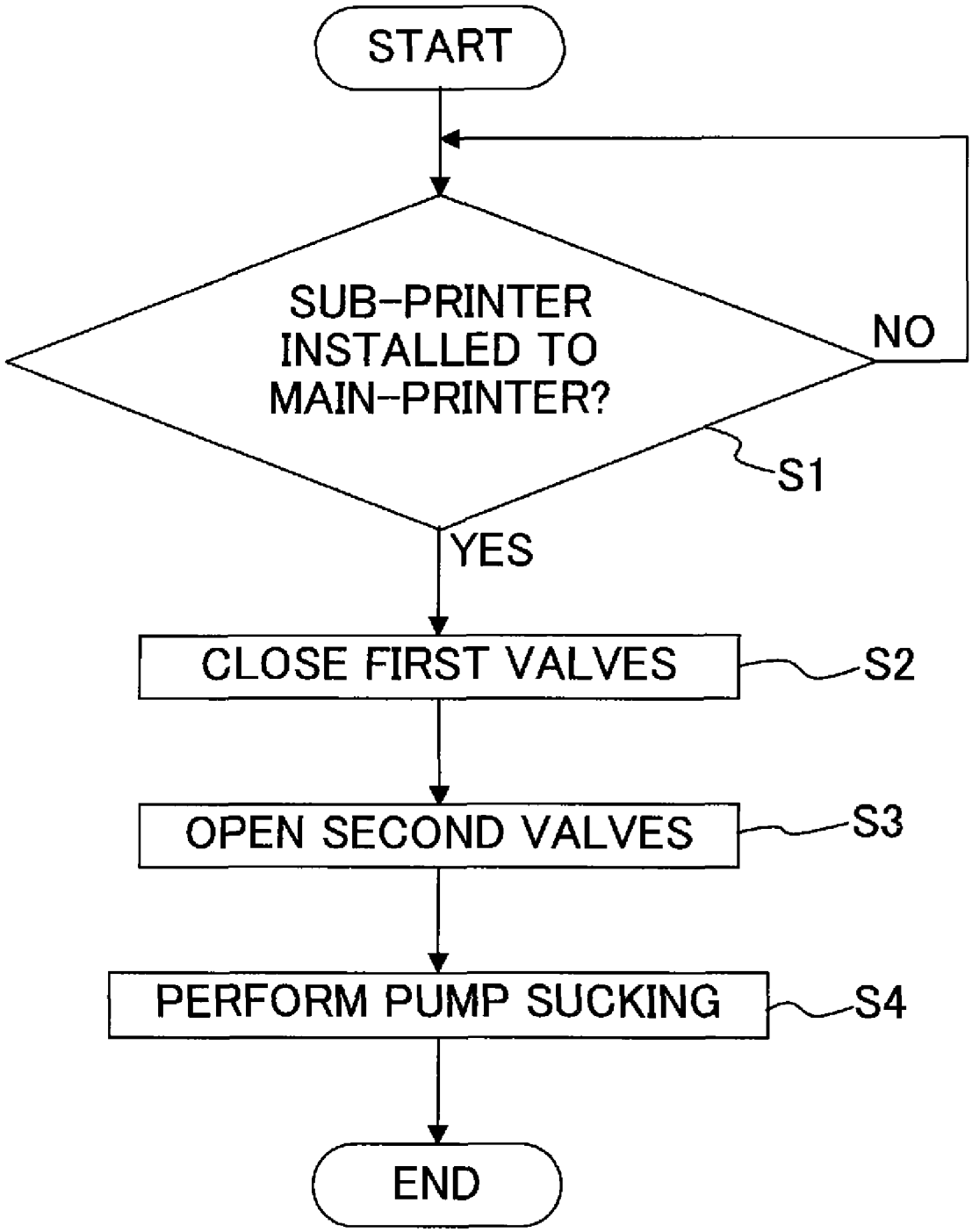
FIG. 7 shows a flow chart illustrating the operation of the main printer when the ink supply is performed from the main printer to the sub printer by using a trigger of the installation of the sub printer in the printer system.

Next, an explanation will be made with reference to flow charts shown in FIGS. 7 to 9 about the ink supply operation for supplying the inks from the main printer 2 to the sub printer 4 in the printer system 1 composed of the main printer 2 and the sub printer 4 as described above. FIG. 7 shows a flow chart illustrating the operation of the main printer 2 when the inks are supplied from the main printer 2 to the sub printer 4 by using the trigger of the installation of the sub printer 4 in the printer system 1.

As shown in FIG. 7, the controller 50 of the main printer 2 judges whether or not the sub printer 4 is installed to the main printer 2 on the basis of the signal supplied from the sub printer-detecting section 56 (S1). If it is judged that the sub printer 4 is not installed (S1: NO), the operation of Step 1 is repeated. If it is judged that the sub printer 4 is installed (S1: YES), the routine proceeds to the next step. As shown in FIG. 5, when the sub printer 4 is installed to the main printer 2, the both are connected to one another by means of the main printer side connecting sections 35 and the sub printer side connecting sections 21. The head cover 24 of the sub printer 4 is opened, and the exposed nozzle surface 23*a* of the second head 23 is hermetically sealed by the second cap 33.

If it is judged in Step 1 that the sub printer 4 is installed to the main printer 2, then the ink flow is regulated between the first ink tanks 13 and the first head 41 by closing the first valves 43 (S2), and the second valves 37 are opened (S3). Accordingly, the first ink tanks 13 of the main printer 2 and the second ink tanks 20 of the sub printer 4 are communicated with each other via the main printer-side connecting sections 35 and the sub printer side-connecting sections 21. Subsequently, the pump 45 is driven by the controller 50 to effect the sucking (S4). Accordingly, the inks are supplied from the first ink tanks 13 to the second ink tanks 20. The first valves 43 are closed during the ink supply. Therefore, the inks are not allowed to flow from the first ink tanks 13 to the first head 41.

When the printer system 1 is operated as described above, the user does not especially worry about the ink residual amounts in the second ink tanks 20 of the sub printer 4, and the inks can be supplied from the main printer 2 to the sub printer 4 merely by installing the sub printer 4 to the main printer 2 when the sub printer 4 is not used.

Figure 8:
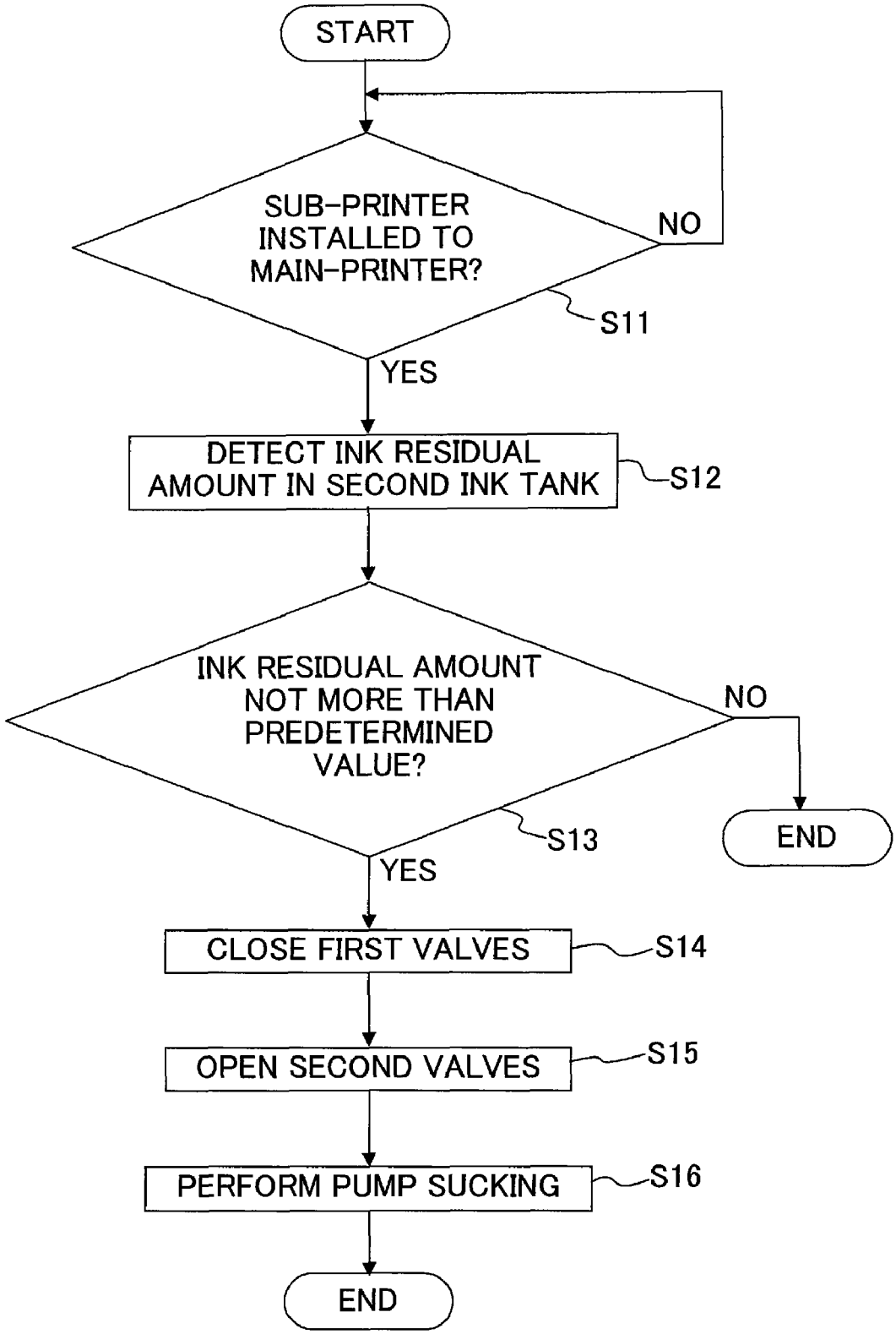
FIG. 8 shows a flow chart illustrating the operation of the main printer when the ink supply is performed depending on the ink residual amount in the second ink tank after the installation of the sub printer in the printer system.

FIG. 8 shows a flow chart illustrating the operation of the main printer 2 when the inks are supplied depending on the ink residual amounts in the second ink tanks 20 by using the trigger of the installation of the sub printer 4 to the main printer 2 in the printer system 1. As shown in FIG. 8, the controller 50 of the main printer 2 judges whether or not the sub printer 4 is installed to the main printer 2 on the basis of the signal supplied from the sub printer-detecting section 56 (S11). If it is judged by the controller 50 that the sub printer 4 is not installed (S11: NO), the operation of Step 11 is repeated. If it is judged that the sub printer 4 is installed (S11: YES), the residual amount-detecting section 57 (see FIG. 6) is controlled to detect the ink residual amounts of the second ink tanks 20 possessed by the sub printer 4 (S12).

Subsequently, it is judged by the controller 50 that the ink residual amounts in the second ink tanks 20 are not more than a predetermined value on the basis of the signal supplied from the residual amount-detecting section 57 (S13). The predetermined value may be zero value at which the ink is not present at all in the second ink tank 20. If necessary, the predetermined value may be set to an arbitrary value. If it is judged in Step 13 that the ink residual amount is larger than the predetermined value (S13: NO), the ink supply operation is completed without supplying the ink to the second ink tank. On the other hand, if it is judged in Step 13 that the ink residual amount is not more than the predetermined value (S13: YES), the operation is performed in the same manner as in Steps 2 to 4 shown in FIG. 7. That is, the first valves 43 are closed (S14), the second valves 37 are opened (S15), and the pump 45 is finally driven to effect the sucking (S16) so that the inks are supplied from the first ink tanks 13 to the second ink tanks 20.

When the printer system 1 is operated as described above, the inks can be appropriately supplied depending on the degree of decrease of the ink residual amount in the second ink tank 20. When the residual amount-detecting section 57 is constructed so that the residual amount-detecting section 57 is capable of individually detecting the ink residual amounts of the four second ink tanks 20 provided for the sub printer 4, the ink may be supplied to only the second ink tank 20 in which the ink residual amount is not more than the predetermined value. In this case, the second valve 37, which is arranged for the tube 36 to connect the second ink tank 20 to which the ink is intended to be supplied and the first ink tank 13, is opened. The other second valves 37 and all of the first valves 43 are closed. In this state, the pump 45 is driven to effect the sucking. Accordingly, the ink is supplied to only the objective second ink tank 20.

Figure 9:
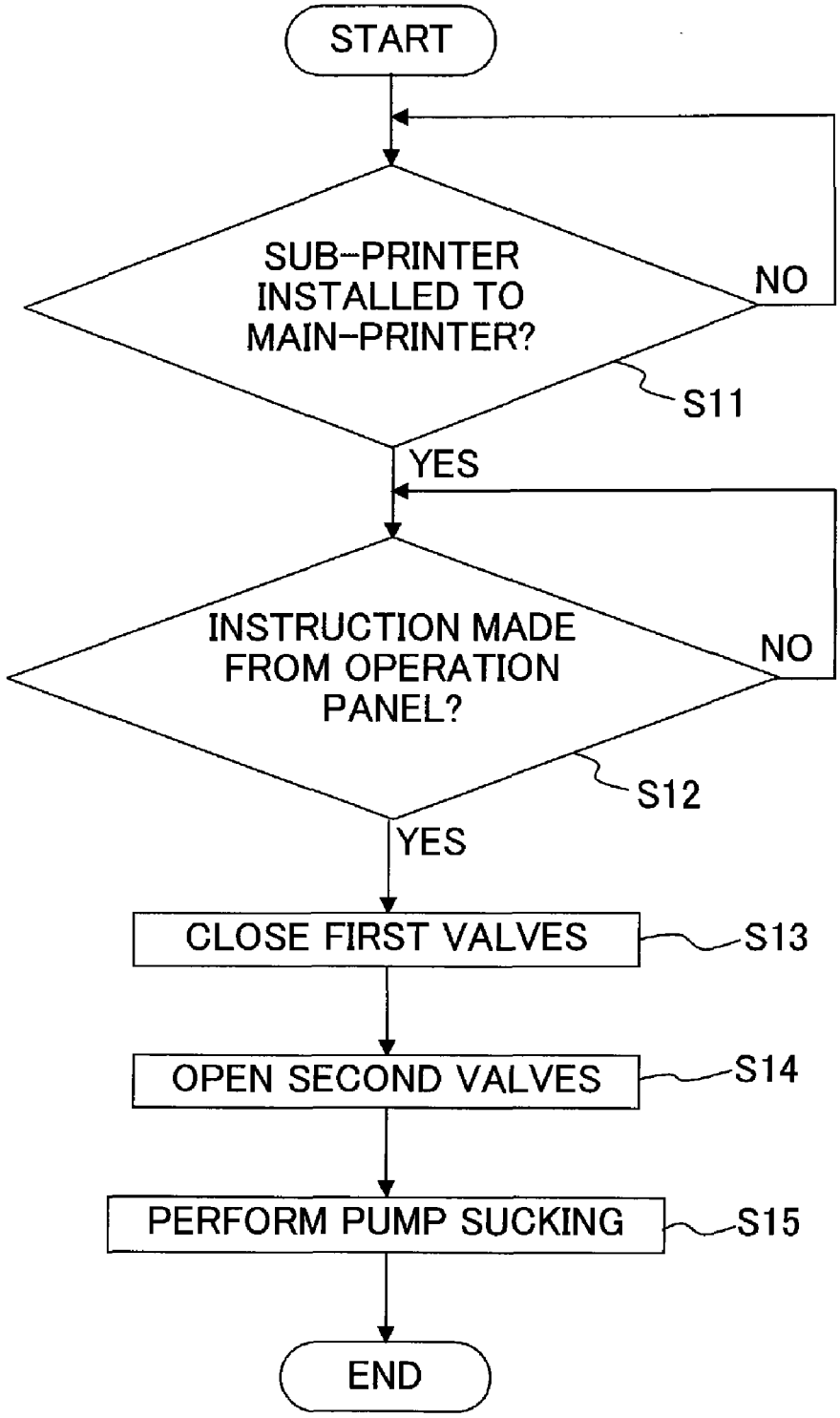
FIG. 9 shows a flow chart illustrating the operation of the main printer when the ink supply is performed on the basis of the operation of the operation panel by the user after the installation of the sub printer in the printer system.

FIG. 9 shows a flow chart illustrating the operation of the main printer 2 when the inks are supplied on the basis of the operation of the operation panel 11 by the user after installing the sub printer 4 in the printer system 1. As shown in FIG. 9, the controller 50 of the main printer 2 judges whether or not the sub printer 4 is installed to the main printer 2 on the basis of the signal supplied from the sub printer-detecting section 56 (S21). If it is judged that the sub printer 4 is not installed (S21: NO), the operation in Step 21 is repeated. If it is judged that the sub printer 4 is installed (S21: YES), it is subsequently judged by the controller 50 whether or not the operation panel 11 is operated by the user and the signal to execute the ink supply operation is outputted from the operation panel 11 (S22).

If it is judged by the controller 50 that the signal of the execution is not outputted from the operation panel 11 (S22: NO), the operation in Step 22 is repeated. If it is judged that the signal is outputted (S22: YES), the operation is thereafter performed in the same manner as in Steps 2 to 4 as having been already explained. That is, the first valves 43 are closed (S23), the second valves 37 are opened (S24), and the pump 45 is finally driven to effect the sucking (S25) so that the inks are supplied from the first ink tanks 13 to the second ink tanks 20.

When the printer system 1 is operated as described above, the inks can be supplied to the sub printer 4 at the timing determined by the user. Therefore, for example, even when the sub printer 4 is installed to the main printer 2 during which the inks are discharged from the first head 41 of the main printer 2 to form the image on the recording paper, then the printing by the main printer 2 is not interrupted, and the inks are not supplied to the sub printer 4. The inks can be supplied to the sub printer 4 at the timing desired by the user after the completion of the printing by the main printer 2.

In the operations of the printer system 1 shown in FIGS. 7 to 9, the timing, at which the ink supply to the sub printer 4 is completed, may be set arbitrarily. For example, the ink may be supplied from the first ink tank 13 to the second ink tank 20 until the second ink tank 20 is fully filled. Alternatively, the ink may be supplied from the first ink tank 13 to the second ink tank 20 until the ink amount in the second ink tank 20 arrives at a predetermined amount.

Alternatively, for example, when the residual amount-detecting section 57 can be used to detect the supply of the ink to the second ink tank 20 in an amount of not less than a predetermined amount, the ink supply operation may be completed at a point of time at which the detection is effected as well. Further alternatively, the user may set the ink supply amount by operating the operation panel 11.

The pump 45, which is provided for the main printer 2, can be also used as a pump to purge the first head 41. Further, the pump 45 can be also used as a pump to purge the second head 23 of the sub printer 4 when the sub printer 4 is installed to the main printer 2. In this way, in the printer system 1 according to the first embodiment of the present invention, the single pump 45 can be used to execute the ink supply to the second ink tanks 20, the purge for the first head 41, and the purge for the second head 20. Therefore, it is unnecessary to prepare individual pumps depending on the respective processes. It is possible to realize the small size and the low price of the main printer 2 and the sub printer 4. Further, it is possible to realize the large volumes of the second ink tanks 20, because the sub printer 4 is not provided with any pump. In this embodiment, for example, the first and second valves 43, 37, the pump 45, the main-side connecting section (first connecting section), and the controller 50 correspond to the first supply mechanism, and the subsidiary-side connecting section (second connecting section) 21 corresponds to the second supply mechanism.

Second Embodiment

Figure 10:
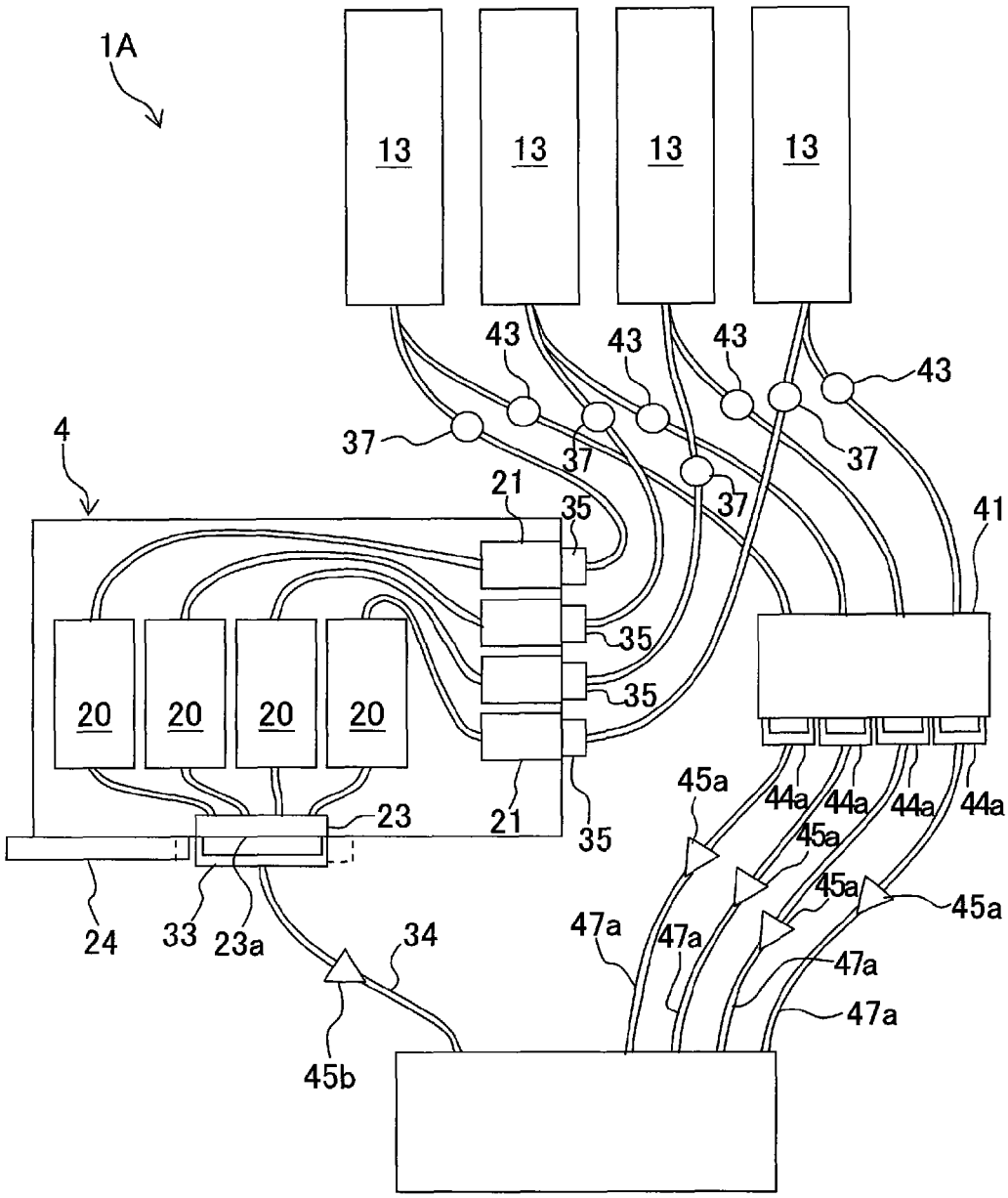
FIG. 10 schematically shows a printer system 1A according to a second embodiment.

FIG. 10 schematically shows a printer system 1A, which depicts a form of connection according to a second embodiment when a sub printer 4 is installed to a main printer 2. As shown in FIG. 10, the printer system 1A includes four first caps 44 which cover the nozzle surface 41*a* of the first head 41 individually for respective colors, tubes 47*a* which are provided to extend from the first caps 44 to the waste ink-accommodating section 46 respectively, and pumps 45*a* which are provided at intermediate positions of the tubes 47*a* respectively to suck the internal fluids contained in the tubes 47*a*. Further, an individual pump 45*b* is provided for the tube 34 which extends from the second cap 33. The other parts or components are constructed in the same manner as those of the printer system 1 according to the first embodiment. Therefore, the corresponding parts or components are designated by the same reference numerals, any explanation of which will be omitted in this embodiment.

In the case of the printer system 1A constructed as described above, the purge process can be executed for the first head 41 for each of the colors. Further, the pump 45*b* is provided, which is exclusively used for the ink supply to the sub printer 4. Therefore, any pump, which has the specification suitable for the ink supply process to the sub printer 4, can be adopted as the pump 45*b*. The printer system 1A is capable of supplying the inks to the sub printer 4 in the same manner as in the printer system 1. The operation, the function, and the effect of the printer system 1A are the same as those having been already explained with reference to FIGS. 7 to 9, any explanation of which will be omitted in this embodiment.

Third Embodiment

Figure 11:
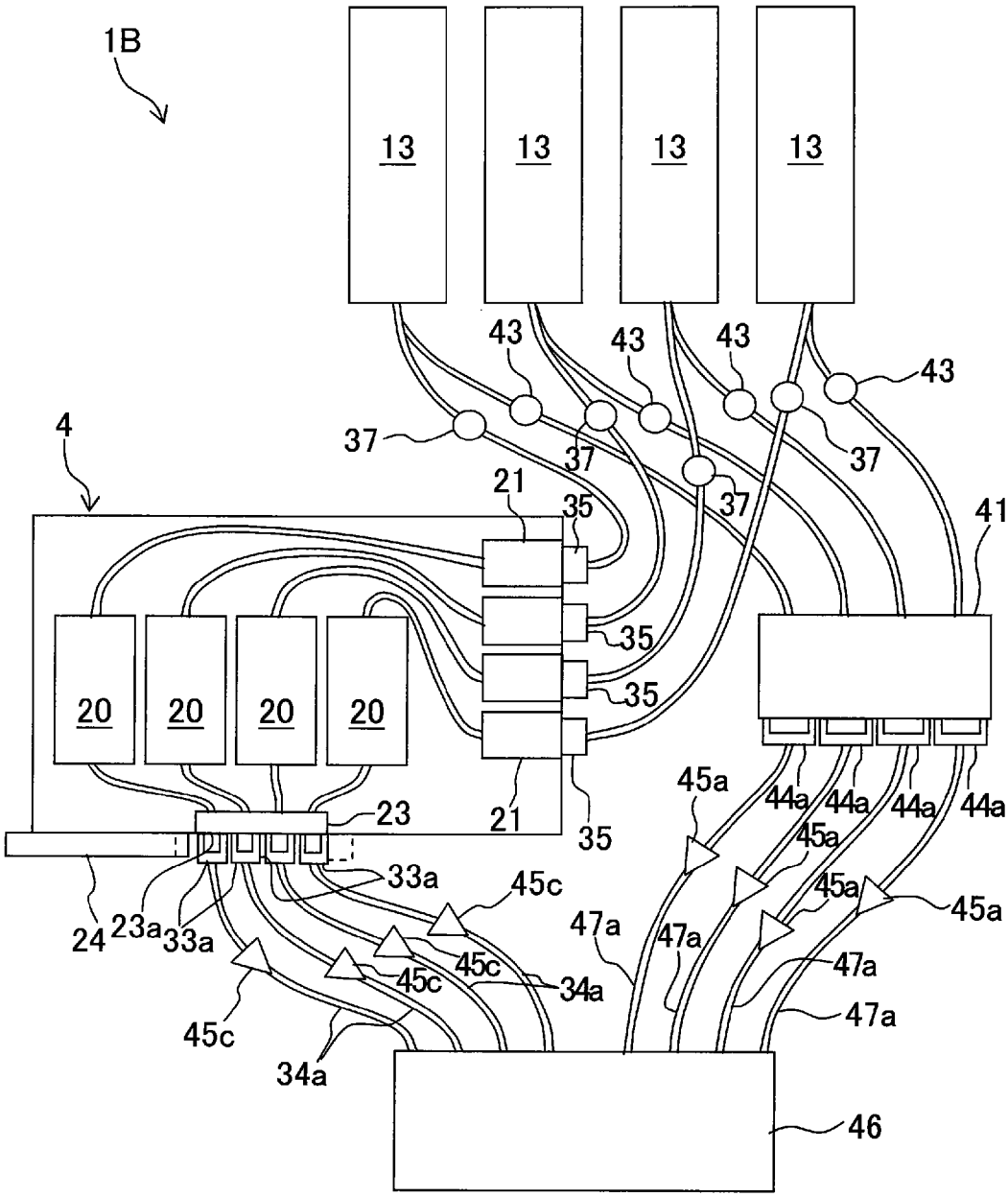
FIG. 11 schematically shows a printer system 1B according to a third embodiment.

FIG. 11 schematically shows a printer system 1B according to a third embodiment. The printer system 1B shown in FIG. 11 is different from the printer system 1A (see FIG. 10) in the form of connection between the sub printer 4 and the waste ink-accommodating section 46. In particular, the printer system 1B includes individual second caps 33*a* which hermetically seal the nozzle surface 23*a* of the second head 23 of the sub printer 4 for the respective colors, tubes 34*a* which extend from the second caps 33*a* respectively to the waste ink-accommodating section 46, and pumps 45*c* which are provided at intermediate positions of the tubes 34*a* respectively to suck the internal fluids contained in the tubes 34*a*. The other parts or components are constructed in the same manner as those of the printer system 1A shown in FIG. 10. Therefore, the corresponding parts or components are designated by the same reference numerals, any explanation of which will be omitted in this embodiment.

In the printer system 1B, the ink can be selectively supplied for each of the colors to each of the second ink tanks 20 of the sub printer 4. For example, even when the ink residual amount in one ink tank 20 of the four ink tanks 20 is decreased, it is possible to supply only the ink of the one color.

When the ink of the selected color is supplied, it is possible to decrease the number of valves of the first valves 43 and the second valves 37 to be driven. For example, when the ink of a certain color is supplied to the second ink tank 20 of the sub printer 4, the following procedure is available. That is, only one second valve 37 corresponding to this color, which is included in the four second valves 37 for regulating the ink flow and which is arranged between the first ink tanks 13 and the second ink tanks 20, is opened. Only one first valve 43 corresponding to this color, which is included in the four first valves 43 for regulating the ink flow and which is arranged between the first ink tanks 13 and the first head 41, is closed. Further, the pump 45*c* corresponding to this color is driven to effect the sucking. As described above, it is enough to drive the two valves and the one pump 45*c* which are included in the large number of the provided valves 37, 43 and the large number of the provided pumps 45*a*, 45*c*.

Fourth Embodiment

Figure 12:
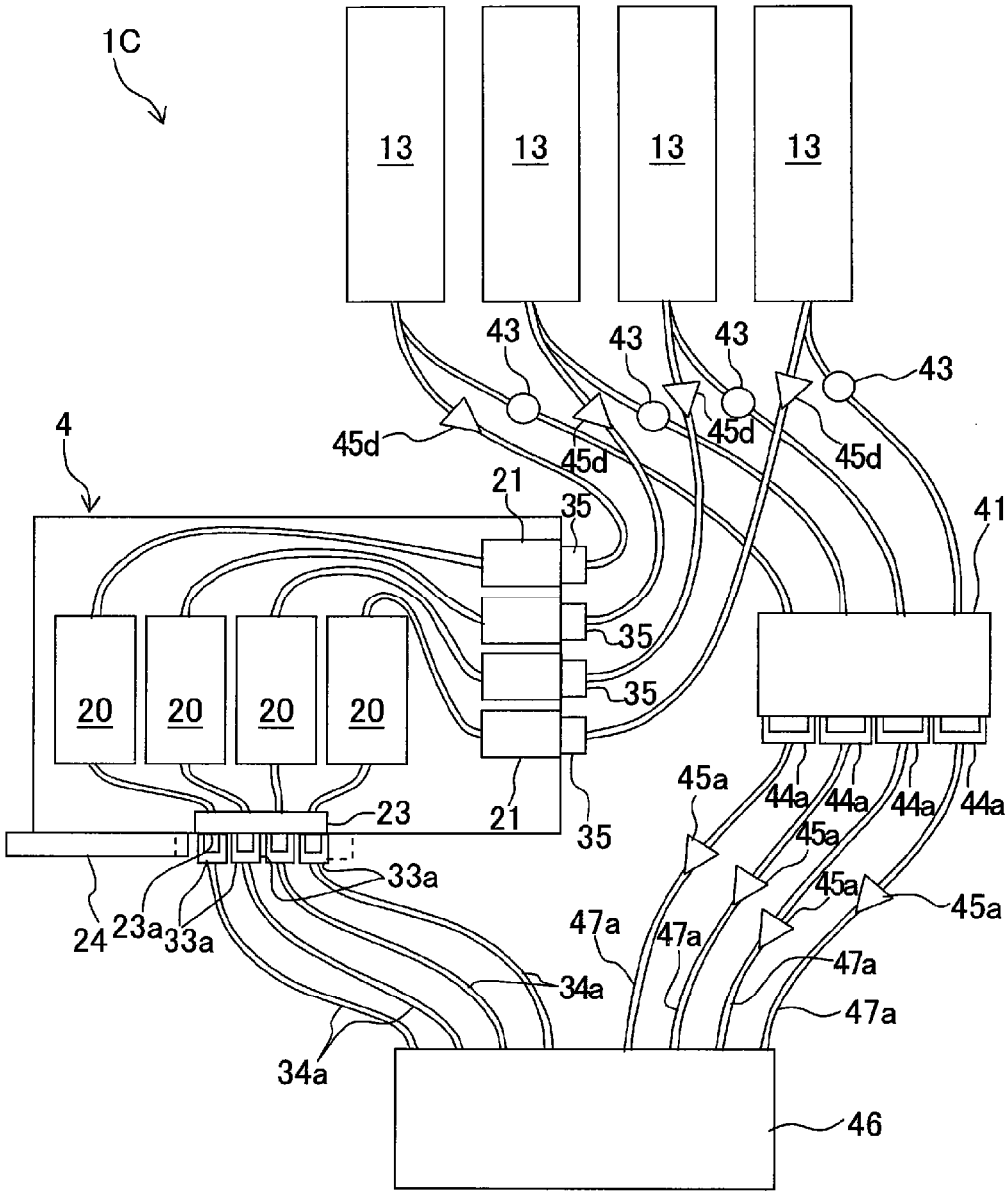
FIG. 12 schematically shows a printer system 1C according to a fourth embodiment.

FIG. 12 schematically shows a printer system 1C according to a fourth embodiment. The printer system 1C shown in FIG. 12 is different from the printer system 1B (see FIG. 11) in that the pumps 45*c* provided between the second caps 33 and the waste ink-accommodating section 46 are removed, and pumps 45*d* are provided in place of the second valves 37 provided between the first ink tanks 13 and the second ink tanks 20. The other parts or components are constructed in the same manner as the printer system 1B. Therefore, the corresponding parts or components are designated by the same reference numerals, any explanation of which will be omitted in this embodiment.

In the case of the printer system 1C, it is unnecessary to provide the second valves 37 provided in the printer systems 1, 1A, 1B in the passages ranging from the first ink tanks 13 via the second ink tanks 20 to arrive at the waste ink-accommodating section 46. Any arbitrary ink can be also selectively supplied to the sub printer 4 by means of the printer system 1C in the same manner as in the printer system 1B described above. Further, it is possible to decrease the number of the first valve or valves 43 to be driven when the ink supply is performed.

Fifth Embodiment

Figure 13:
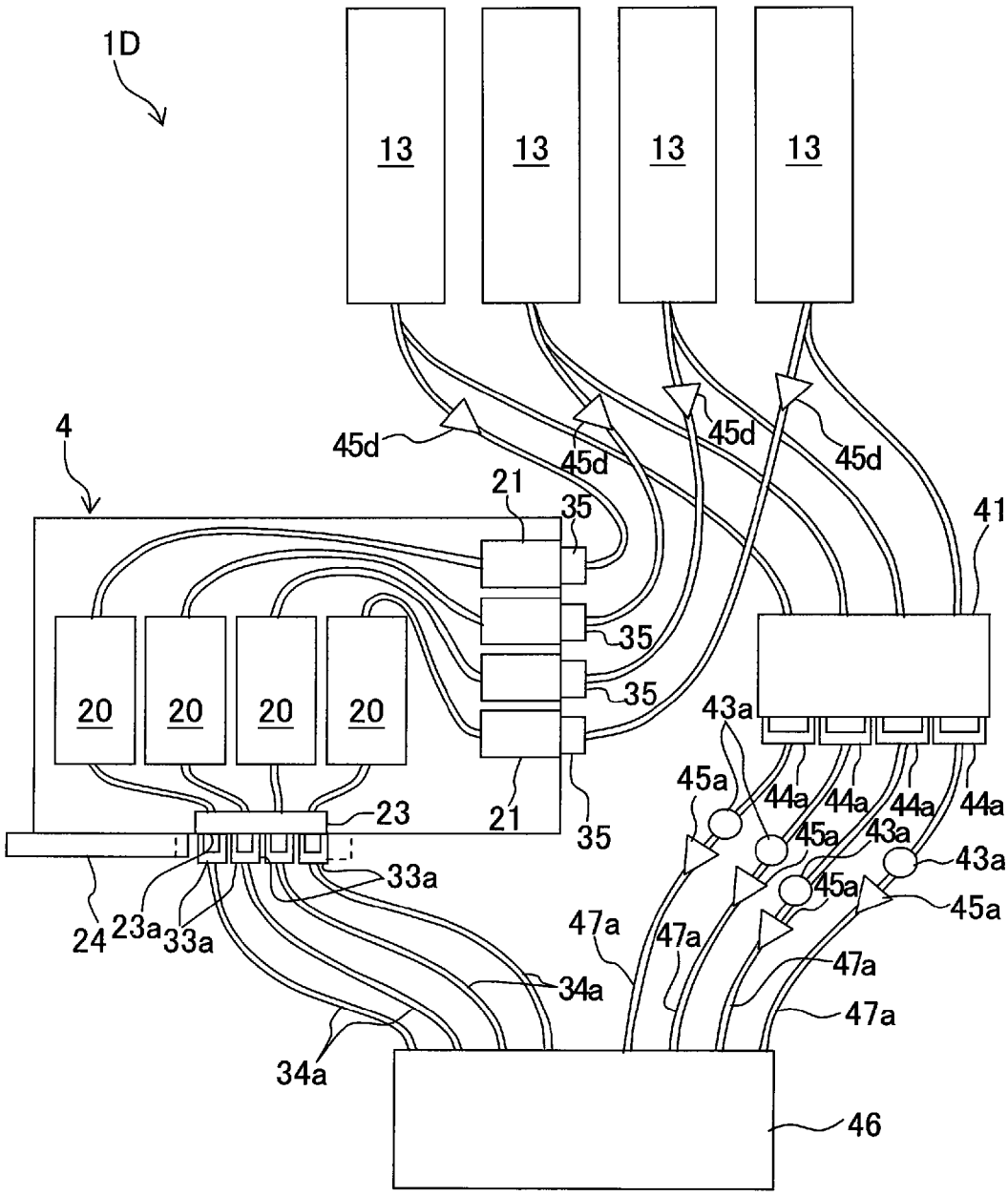
FIG. 13 schematically shows a printer system 1D according to a fifth embodiment.

FIG. 13 schematically shows a printer system 1D according to a fifth embodiment. The printer system 1D shown in FIG. 13 is different from the printer system 1C shown in FIG. 12 in that the first valves 43, which are provided between the first ink tanks 13 and the first head 41 in the printer system 1C, are removed, and first valves 43*a* are provided between the first caps 44*a* and the pump 45*a* at intermediate positions of the tubes 47*a* to make communication between the first caps 44*a* and the waste ink-accommodating section 46. The other parts or components of the printer system 1D are constructed in the same manner as those of the printer system 1C, any explanation of which will be omitted, while the corresponding parts or components are designated by the same reference numerals.

Any ink can be also selectively supplied to the sub printer 4 by means of the printer system 1D in the same manner as in the printer system 1C described above. Further, it is possible to decrease the number of the first valve or valves 43 to be driven when the ink supply is performed.

Sixth Embodiment

Figure 14:
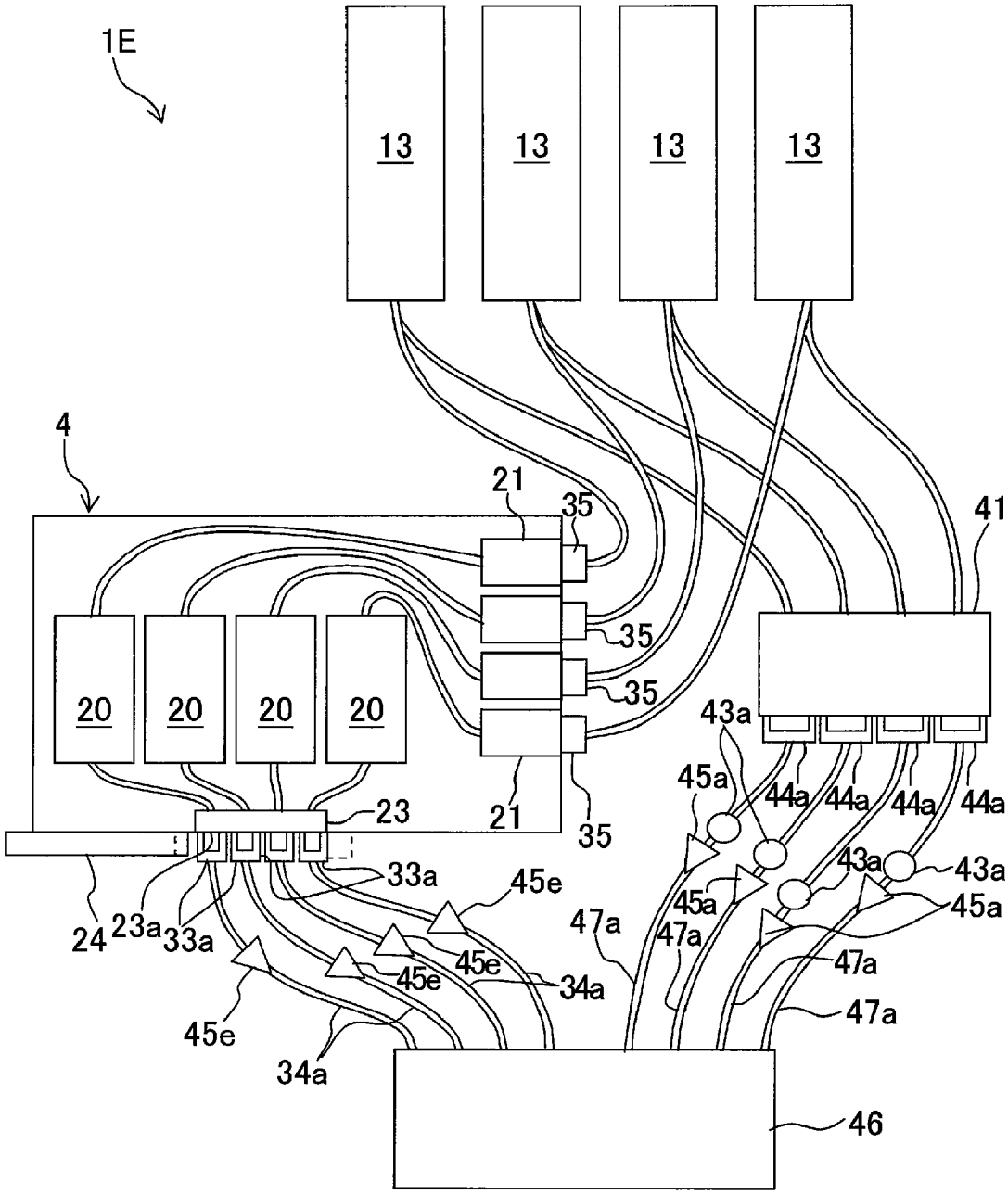
FIG. 14 schematically shows a printer system 1E according to a sixth embodiment.

FIG. 14 schematically shows a printer system 1E according to a sixth embodiment. The printer system 1E shown in FIG. 14 is different from the printer system 1D (see FIG. 13) in that the pumps 45*d*, which are provided between the first ink tanks 13 and the second ink tanks 20 in the printer system 1D, are removed, and pumps 45*e* are provided at intermediate positions of the tubes 34*a* to make communication between the second caps 33*a* and the waste ink-accommodating section 46. The other parts or components of the printer system 1E are constructed in the same manner as those of the printer system 1D, any explanation of which will be omitted, while the corresponding parts or components are designated by the same reference numerals.

Any ink can be also selectively supplied to the sub printer 4 by means of the printer system BE in the same manner as in the printer system 1D described above. Further, it is possible to decrease the number of the first valve or valves 43 to be driven when the ink supply is performed.

Seventh Embodiment

Figure 15:
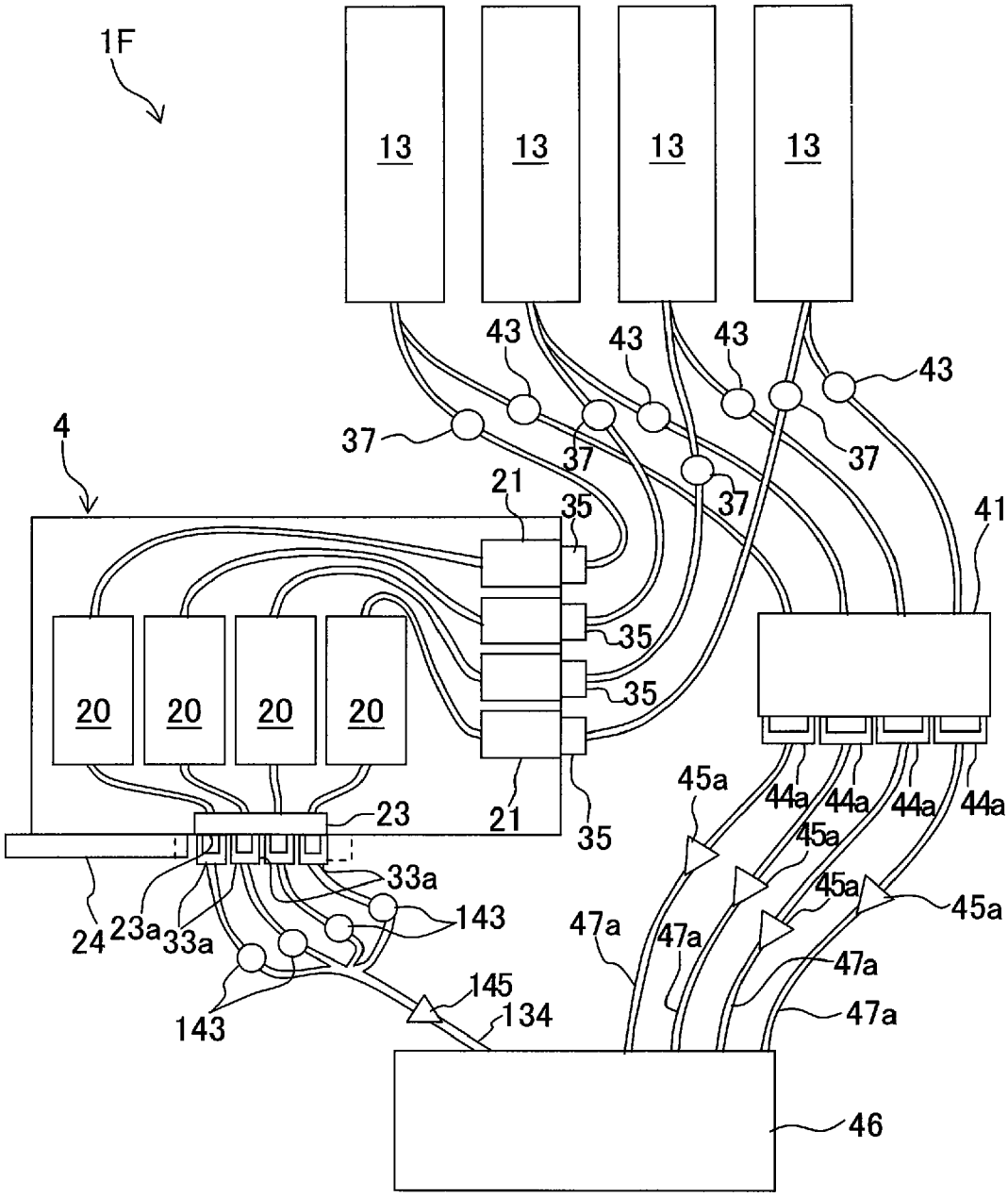
FIG. 15 schematically shows a printer system 1F according to a seventh embodiment.

FIG. 15 schematically shows a printer system 1F according to a seventh embodiment. The printer system 1F shown in FIG. 15 is different from the printer system 1B shown in FIG. 11 in that valves 143 are provided in place of the pumps 45*c* at intermediate positions of the tubes 34*a* allowed to extend from the second caps 33*a*, the tubes 34*a* merge into one tube 134 at the downstream of the valves 143, and a pump 145 for sucking the fluid is provided in the tube 134. Even in the case of the printer system 1F, the inks of the respective colors can be selectively supplied to the second ink tanks 20 of the sub printer 4, and the second head 23 of the sub printer 4 can be selectively purged for the respective colors, in the same manner as in the printer system 1B. Further, it is possible to decrease the number of the pump or pumps required to supply the inks and purge the head. As for the main printer, it is also allowable in the same manner as the above that valves are provided in place of the pumps 45*a* at intermediate positions of the tubes 47*a* allowed to extend from the first cap 44*a*, the tubes 47*a* are allowed to merge into one tube at the downstream, and a pump is provided for the merged tube.

As exemplified in the first to seventh embodiments, in the case of the printer systems 1, 1A to 1F, the ink can be supplied to the sub printer 4 by installing the sub printer 4 to the main printer 2 having the printer function. That is, the main printer 2 can form the image on the recording paper by discharging the inks from the first head 41, because the main printer 2 has the printer function, while the main printer 2 can also supply the inks to the sub printer 4. The main printer 2 is provided with both of the printer function and the ink supply function to supply the inks to the sub printer 4. Therefore, it is unnecessary to prepare any exclusive station specialized to supply the inks to the sub printer 4.

In the printer systems 1, 1A to 1E according to the embodiments of the present invention, the sub printer 4 is installed to the sub printer-installing port 14 of the main printer 2. However, the form of installation of the sub printer 4 to the main printer 2 is not limited thereto. For example, the sub printer 4 may be installed to the main printer 2 such that a main printer side connecting section 35 is provided at the forward end of a tube provided to extend from the main printer 2, and the sub printer side connecting section 21 is connected thereto. In this case, the first ink tank 13 and the second ink tank 20 may be communicated with each other via the tube provided to extend from the main printer 2 so that the inks may be supplied.

It is not necessarily indispensable that the pumps 45, 45*a* to 45*e* are provided at the intermediate positions of the respective tube, which may be provided, for example, at the ends of the respective tubes. When the first ink tank 13 of the main printer 2 is provided with any pressurizing type pump, it is not necessarily indispensable that the pumps 45, 45*a* to 45*e* are provided. The pressurizing type pump may be operated in place of the pump sucking operation (S4, S16, S25) shown in FIGS. 7 to 9. The main printer is not necessarily the multi-function machine having, for example, the scan function. The main printer may have only the printer function. The number and the type of the ink or inks of each of the main printer and the sub printer may be arbitrary. For example, the main printer may be a full color printer for discharging the four color inks of black, cyan, magenta, and yellow, and the sub printer may be a monochrome or black and white printer for discharging only the black ink. In this case, only the black ink is supplied when the sub printer is installed to the main printer. The sub printer may be of the charging type. For example, the sub printer may be charged by receiving the supply of the electric power from the main printer during the period in which the sub printer is installed to the main printer. However, there is no limitation thereto.

The present invention is applicable to the printer system for which any exclusive station is not provided while the portable type printer is of the ink supplement type, wherein the printer system does not cause such a situation that there is no way of use except for the ink supplement and any excessive installation space is required.

What is claimed is:

1. A printer system which performs printing by discharging an ink onto a recording medium, the printer system comprising:

a main printer including a first tank which stores the ink and a first head which discharges the ink supplied from the first tank onto the recording medium;

a portable type sub printer which is detachably accommodated with the main printer, the sub printer including a second ink tank which stores the ink, the second ink tank of which volume is smaller than that of the first tank, and a second head which discharges the ink supplied from the second tank onto the recording medium; and a supply mechanism which connects the first tank and the second tank to supply the ink from the first tank to the second tank when the sub printer is installed to the main printer, wherein the main printer further comprises a first installing section in which the first tank is accommodated detachably and a second installing section to which the sub printer is installed detachably and wherein the supply mechanism comprises a detecting mechanism which detects an installation of the sub printer to the second installing section.

2. The printer system according to claim 1, wherein the supply mechanism includes a first regulating section which regulates a flow of the ink between the first tank and the first head, and the regulating mechanism regulates to stop the flow of the ink between the first tank and the first head when the ink is supplied from the first tank to the second tank.

3. The printer system according to claim 1, wherein:

the supply mechanism includes a first supply mechanism which is provided in the main printer and a second supply mechanism which is provided in the sub printer;

the first supply mechanism includes a first regulating section which regulates a flow of the ink between the first tank and the first head, a first connecting section which is communicated with the first tank and which is connected to the sub printer, and a second regulating section which regulates a flow of the ink between the first tank and the first connecting section;

the second supply mechanism includes a second connecting section which is communicated with the second tank and which is connected to the first connecting section to make communication between the first tank and the second tank when the sub printer is installed to the main printer; and the first regulating section and the second regulating section are operable independently from each other.

4. The printer system according to claim 3, wherein the supply mechanism supplies the ink from the first tank to the second tank when the first connecting section and the second connecting section are connected to one another.

5. The printer system according to claim 3, wherein the supply mechanism supplies the ink from the first tank to the second tank when the first connecting section and the second connecting section are connected to one another and a residual amount of the ink contained in the second tank of the sub printer is not more than a predetermined value.

6. The printer system according to claim 3, further comprising: an input device which inputs a predetermined instruction, wherein the supply mechanism supplies the ink from the first tank to the second tank when the first connecting section and the second connecting section are connected to one another and an instruction to execute ink supply to the second tank of the sub printer is inputted via the input device.

7. The printer system according to claim 1, wherein the supply mechanism includes a pump which supplies the ink contained in the first tank to the first head and which supplies the ink from the first tank to the second tank.

8. The printer system according to claim 1, wherein the main printer includes a casing in which the first head is accommodated and the first installing section and the second installing section are arranged adjacently on an identical wall surface of the casing.

9. The printer system according to claim 1, wherein the supply mechanism includes an ink amount-detecting mechanism which detects an ink amount contained in the second tank of the sub printer.

10. A main printer which performs printing by discharging an ink onto a recording medium, the main printer comprising:

a first tank which stores an ink;

a first head which discharges the ink supplied from the first tank onto a recording medium;

an installing section which accommodates detachably a portable type sub printer including a second tank which stores the ink and which has a volume smaller than that of the first tank, and a second head which discharges the ink supplied from the second tank onto the recording medium;

a supply mechanism which connects the second tank and the first tank to supply the ink from the first tank to the second tank when the sub printer is installed to the installing section;

a first installing section in which the first tank is accommodated detachably; and a second installing section to which the sub printer is installed detachably, wherein the supply mechanism comprises a detecting mechanism which detects an installation of the sub printer to the second installing section.

11. The main printer according to claim 10, wherein the supply mechanism further comprises a first regulating section which regulates a supply of the ink from the first tank to the first head, a connecting section which connects the first tank and the second tank in a communicated state, and a second regulating section which regulates a supply of the ink from the first tank to the connecting section.

12. A portable type sub printer which performs printing by discharging an ink onto a recording medium, the sub printer comprising:

a second tank which stores the ink; and a second head which discharges the ink supplied from the second tank, wherein the sub printer is detachably installed to a main printer including the first tank which stores the ink and a first head which discharges the ink supplied from the first tank onto the recording medium, the second tank has a volume smaller than that of the first tank, and the second tank is communicated with the first tank when the sub printer is installed to the main printer, and the main printer further comprises a first installing section in which the first tank is accommodated detachably and a second installing section to which the sub printer is installed detachably and a detecting mechanism which detects an installation of connecting sections of the sub printer to the second installing section.

13. The sub printer according to claim 12, further comprising a connecting section which connects the first tank and the second tank in a communicated state.

14. The sub printer according to claim 12, further comprising a roller which maintains a constant distance between the second head and the recording medium, a position-detecting section which detects a position of the sub printer based on an angle of rotation of the roller, and a control mechanism which is connected to the position-detecting section and which controls discharge of the ink from the second head.

15. A method for supplying an ink for a printer system, the printer system comprising:

a main printer including a first tank which stores the ink and a first head which discharges the ink supplied from the first tank onto the recording medium;

a portable type sub printer accommodated detachably with the main printer, the sub printer including a second tank which stores the ink, the second tank having a volume smaller than that of the first tank, and a second head which discharges the ink supplied from the second tank onto a recording medium; and an ink supply mechanism including a first valve which regulates a flow of the ink between the first tank and the first head, a second valve which regulates a flow of the ink between the first tank and the second tank, and a pump which supplies the ink from the first tank to the second tank, and the method comprising:

detecting whether or not the sub printer is installed the main printer;

opening the first valve and closing the second valve when the installation of the sub printer is not detected; and disengaging the pump to supply the ink from the first tank to the second tank when the installation of the sub printer is not detected.

16. The method for supplying the ink according to claim 15, further comprising detecting an amount of the ink contained in the second tank, wherein the first valve is closed and the second valve is opened when the installation of the sub printer is detected and the amount of the ink contained in the second tank is not more than a predetermined amount.

17. The method for supplying the ink according to claim 15, wherein the printer system further comprises an input device which inputs a predetermined instruction, and the method further comprises closing the first valve and opening the second valve when the installation of the sub printer is detected and an instruction to execute ink supply to the second tank is inputted via the input device.

* * * * *